United States Patent [19]

Mills

[11] Patent Number: 5,002,524

[45] Date of Patent: Mar. 26, 1991

[54] PRECRUSH TOOL FOR CORRUGATED BOARD SLOTTER HEAD

[75] Inventor: George R. Mills, Clementon, N.J.

[73] Assignee: The Langston Corporation, Cherry Hill, N.J.

[21] Appl. No.: 462,175

[22] Filed: Jan. 8, 1990

[51] Int. Cl.[5] ..... B31B 1/14

[52] U.S. Cl. ..... 493/354; 493/471; 83/332; 83/863; 83/678

[58] Field of Search ..... 493/354, 407, 464, 365, 493/471, 370, 355; 83/332, 863, 678

[56] References Cited

U.S. PATENT DOCUMENTS

| | | | |
|---|---|---|---|
| 1,027,822 | 5/1912 | Daven | 493/354 |
| 1,746,048 | 2/1930 | Novick | 493/365 |
| 1,988,451 | 1/1935 | Knowlton | 493/365 |
| 2,201,185 | 5/1940 | Knowlton | 493/365 |
| 2,718,828 | 9/1955 | Buda et al. | 83/332 |
| 3,314,340 | 4/1967 | Bishop | 493/365 |
| 3,443,490 | 5/1969 | Bishop | 493/354 X |
| 3,518,922 | 7/1970 | Kuehn | 83/332 |
| 3,771,425 | 11/1973 | Matsuo | 493/354 X |
| 4,019,428 | 4/1977 | Grobman | 493/354 X |
| 4,432,746 | 2/1984 | Deltaan | 493/365 X |
| 4,596,541 | 6/1986 | Ward, Sr. et al. | 493/354 X |

*Primary Examiner*—D. S. Meislin

*Attorney, Agent, or Firm*—Seidel, Gonda, Lavorgna & Monaco

[57] ABSTRACT

A precrush tool immediately precedes a slotting blade in a slotting tool assembly. The slotting blade is mounted in the same way as a conventional slotting blade with the exception that the top is profiled to give gradual crushing during rotation. The tool's area gets successively larger to the point that the top land equals the width of the slotter blade and its O.D. when mounted is effectively the pitch circle of the tool assembly. This design allows for the air to be removed from the board gradually and produces a sharp clean cut by the slotter.

9 Claims, 2 Drawing Sheets

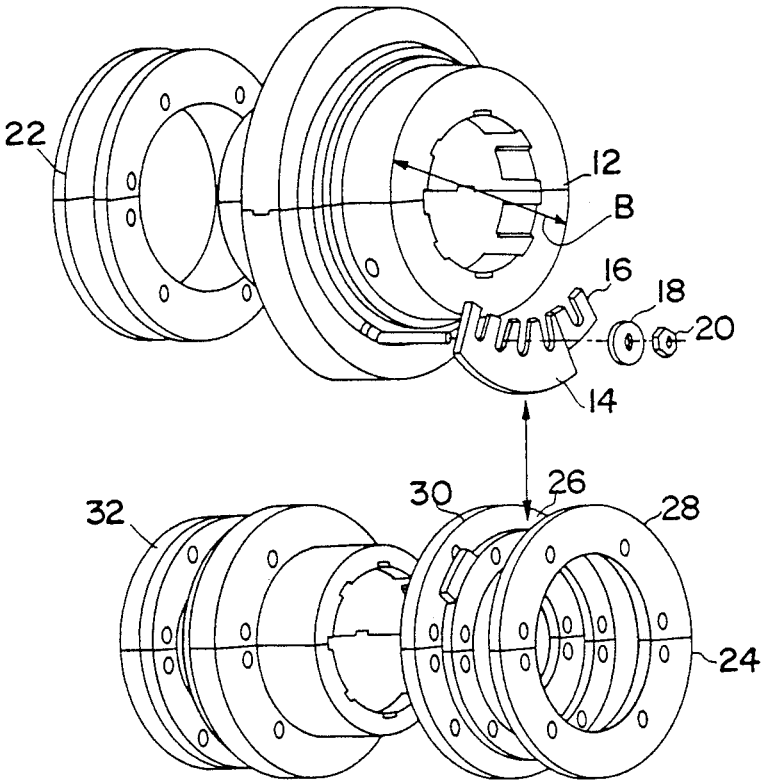
FIG.1
FIG.2
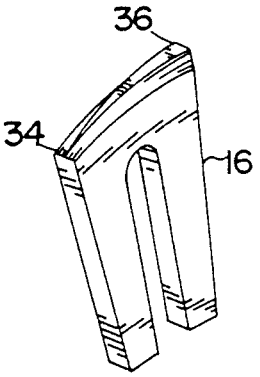
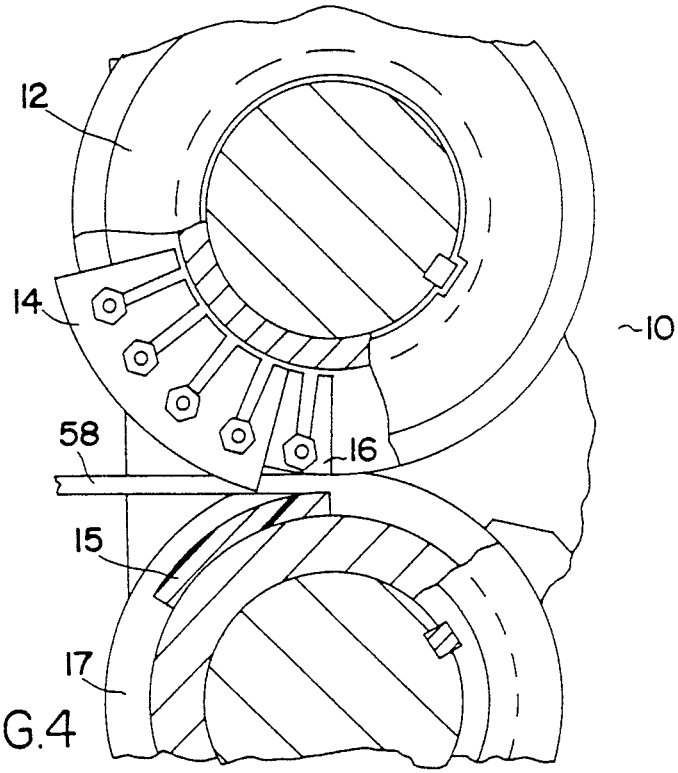
FIG.4

PRECRUSH TOOL FOR CORRUGATED BOARD SLOTTER HEAD

FIELD OF THE INVENTION

The present invention relates to the manufacture of corrugated board and, in particular, to improvements in the manufacture of slotted board for use in corrugated boxes and the like.

BACKGROUND OF THE INVENTION

Corrugated board and corrugated boxes are widely used and well-known. Corrugated boxes are typically assembled from corrugated blanks which are cut from a web of corrugated board. A typical blank is provided with flaps and score lines which are used to assemble the blank into a finished box.

The flaps on a corrugated blank are formed in a machine generally known as a flexo folder gluer, or "flexo" for short. A flexo is exemplary of a machine which has a plurality of rotating tools mounted on a common shaft. A flexo forms the flaps on a blank with a mechanism referred to as a slot-crease-slot mechanism. In a slot-crease-slot, a set of slotting tools is mounted to a first arbor to cut slots in the forward edge of the blank, a set of creasing (scoring) tools is mounted to a second arbor to form fold lines, and a second set of slotting tools is mounted to a third arbor to cut slots in the trailing edge of the blank. This arrangement allows the radial registration of slot location to be done automatically, for example, as shown in U.S. Pat. No. 4,003,300.

Conventional slotting heads on a printer slotter comprise a male tool and a female tool. The male tool is provided with at least one slotter blade which projects beyond the periphery of the tool. The blade is adapted to cooperate with an annular groove in an opposing female slotting tool. The slotting tools are mounted on rotatable parallel shafts.

An inherent manufacturing problem exists in the manufacture of corrugated board done in this manner. Corrugated board by nature is cushioned since it contains air. In order to slot effectively, the air must be removed from the product. This is handled well by the second set of slotting tools since the preceding creasing tools plastically deform the corrugated board prior to slotting, thus removing the air.

The first set of slotting tools does not have any preceding creasing mechanism and must remove the air instantaneously and coincidentally with the commencement of slotting. This results in jagged slots (not sheared but torn instead) and can damage the area at the root of the slot by spalling and fracturing the liners of the board. Corrugated board requires structural strength to allow stacking, and large stresses are concentrated in the corners. Damage to the flaps produces a pre-shear and/or stress riser in the corners which is undesirable, as it causes the product to fail in use.

SUMMARY OF THE INVENTION

The present invention is directed to a slotter blade immediately preceded by a precrusher in a slotter tool assembly. The combination is similar to a standard slotter blade and is mounted in the same manner, with the exception that the top of the precrush tool is profiled to give gradual crush during rotation The precrush tool becomes successively larger in area to the point at which the width of the crushing surface equals the width of the slotter blade, and its maximum O.D. when mounted is effectively the pitch circle of the tool assembly. This arrangement eliminates the aforementioned spalling/fracturing as the work energy is no longer instantaneous but spread over a radial distance.

The precrush tool is mounted on the same shaft and precedes the male slotting blade on the first set of slotting tools. The precrush tool is uniquely shaped so that the diameter of the tool measured from the axis of the shaft gradually increases along the circumference of the tool in a direction toward the male slotting blade. At the same time, the width of the circumferential surface of the precrush tool increases as the diameter increases, until it is substantially equal to the width of the male slotting blade. This design allows for air to be removed from the board gradually prior to cutting and enables a sharp, clean cut by the slotting blade.

The exact manner in which the invention achieves these and other objects and advantages will become more clearly apparent when reference is made to the following detailed description of the preferred embodiments of the invention set forth by way of example and shown in the accompanying drawings, wherein like reference numerals indicate corresponding parts throughout.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 an exploded view of a set of slotting tools with a precrush tool according to the present invention.

FIG. 2 is a perspective view of the precrush tool.

FIG. 4 is a vertical sectional view of the set of tools of FIG. 3 operating on a corrugated board.

DESCRIPTION OF THE INVENTION

Figure 3:
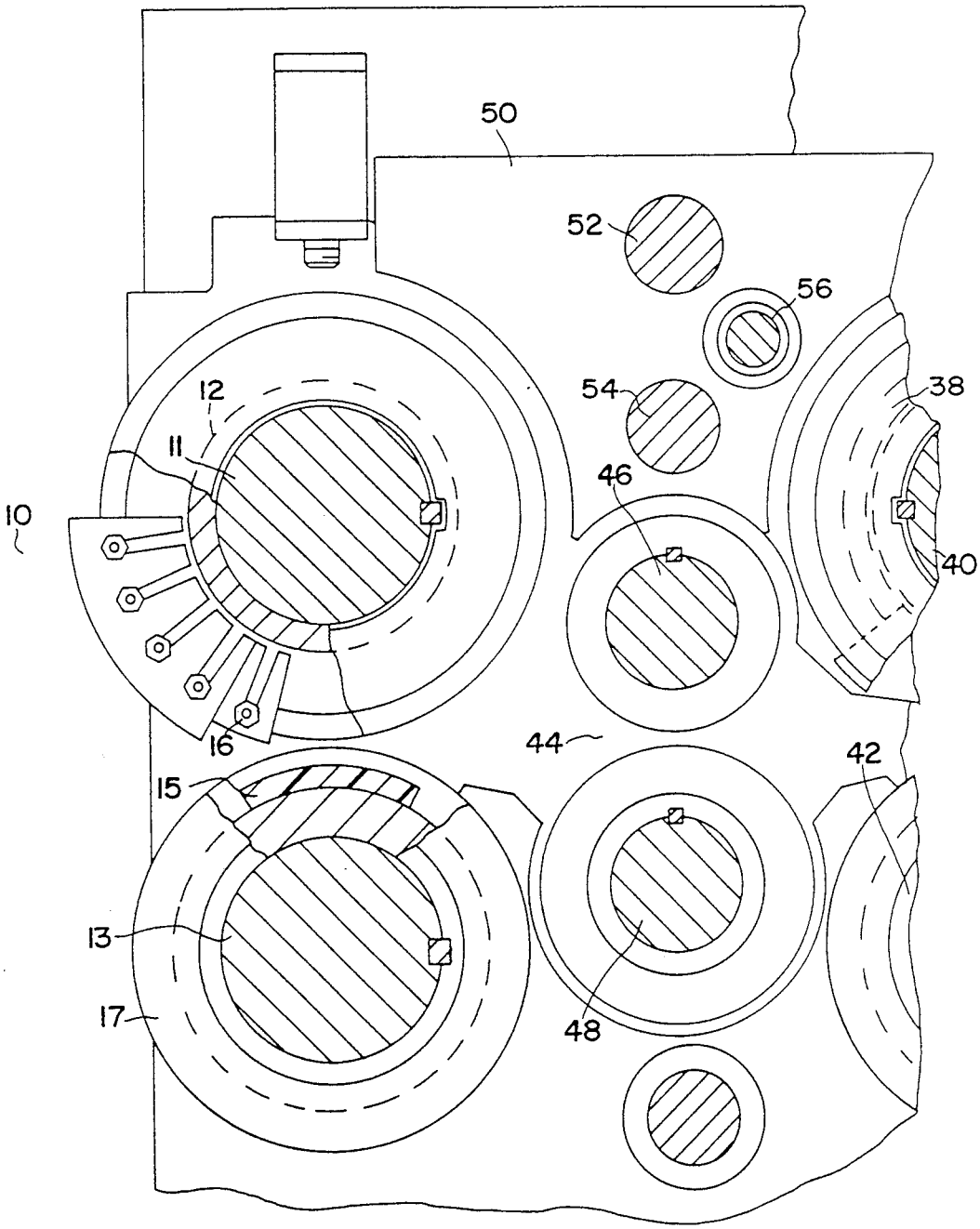
FIG. 3 is a vertical sectional view of a set of slotting tools with the precrush tool according to the present invention, shown in relation to a portion of a flexo folder gluer.

FIG. 1 shows a preferred embodiment of the slotter assembly 10 and its basic components. The male slotter tool 12 has a slotting blade 14 and a precrush tool 16 connected to the male slotting tool 12 by means of a screw with a washer 18 and nut 20 assembly. The male slotting tool 12 is connected to a wear plate 22. The diameter of the portion of the male slotting tool 12 to which precrush tool 16 is mounted is referred to herein as the "base circle" B.

The female slotting tool 24 has an annular slotting groover 26 defined by two slotting rings 28 and 30. The slotting rings 28, 30 are connected to the female slotting tool 24 and a wear plate 32. The slotting blade 14 and precrush tool 16 on the male slotting tool 12 correspond to and mate with the slotting groover 26 on the female tool 24 as shown by arrow 1.

FIG. 2 is an enlarged view of the precrush tool 16. The tool 16 is generally wedge shaped and the circumferential surface has a narrow leading end 34 which gradually increases in width toward a trailing end 36. The width of the trailing end 36 substantially equals the slotting blade width. The tool 16 also increases in diameter from the leading end 34 to the trailing end 36. The leading end diameter is equal to the base circle, which, as those skilled in the art will understand, equals the pitch circle minus the caliper or thickness corrugated board of the product. Stated alternatively, the pitch circle diameter equals the base circle diameter plus the thickness of the product. The diameter of the trailing end 36 is equal to the pitch circle. The maximum diameter of the tool 16 is less than that of the blade 14.

FIG. 3 shows a machine for forming boxes comprising a conventional second slotting assembly 38 mounted on shafts 40 and 42, a creaser assembly 44 mounted on shafts 46 and 48, and a first slotting assembly 10 mounted on shafts 11 and 13 with a precrush tool 16.

Each slotting assembly 10, 38 and creaser assembly 44 comprises a female tool and a male tool. The female tool 17 of the first slotting assembly 10 has an elastomer support anvil 15 which cooperates with the precrush tool 16 on the male slotting tool 12. The anvil 15 has the resilience necessary to adequately support the board 58 (FIG. 4) with a reactive load while the precrush tool 16 is in position and operating on board 58.

On the male slotting tool 12, the first slotting assembly 10 has a slotting blade 14 on a portion of its circumference which is immediately preceded by the precrush tool 16. The machine has a yoke 50 for each slotting assembly 10, 38. The yoke 50 is guided for horizontal translation by means of guide shafts 52 and 54. A threaded drive shaft 56 is threadedly coupled to the yoke 50 for causing the same to reciprocate to a desired position along the length of guide shafts 52 and 54.

As shown in FIG. 4, during operation a corrugated board 58 passes through the male slotting tool 12 and female slotting tool 17 of the first slotting assembly 10. The board 58 comes in contact with the precrush tool 16 and is supported by the elastomer anvil 15 on the female slotting tool 17. The precrush tool 16 causes the air to be removed from the board 58 in a gradual manner. The board 58 then comes into contact with the slotting blade 14. The addition of the precrush tool 16 to the slotting blade 14 eliminates t he spalling and fracturing of the board because the work energy is spread over a radial distance. The board 58 then passes through the creaser and second slotting assembly in the conventional manner.

The precrush tool enables a sharp clean cut by the slotting assembly. The tool is uniquely shaped so as to gradually and effectively remove the air from the corrugated board.

An advantage to the precrush tool is that it can be easily added to existing machinery and is low in cost. The tool also helps the board to retain its strength since most of the structural strength is in the corners and spalling and fracturing of the board by the slotter, which will weaken the corners is eliminated.

I claim:

1. A slotter assembly comprising:

a pair of rotatable tools for receiving a corrugated board therebetween;

crushing means mounted on one of said rotatable tools and resilient means on the other of said rotatable tools for cooperating with said crushing means for contacting said corrugated board and plastically deforming said board to gradually form a crease therein; and slotting means on said one of said rotatable tools for contacting the board after said crushing means for producing at least one slot at at least one slotting location in said board;

said crushing means increasing in circumferential area and diameter in a direction toward said slotting means.

2. A slotting assembly according to claim 1 wherein the diameter and circumferential area of said slotting means is at least equal to that of said crushing means.

3. In a corrugated board slotting assembly having a male slotting blade mounted for rotation on a rotatable shaft and a cooperating female slotting head, the male slotting blade having a slotting area, the male slotting blade and female slotting head being arranged to receive between them a corrugated board to be slotted, a precrush tool mounted on the rotatable shaft, the precrush tool comprising a curved board engaging surface having a leading edge and a trailing edge, the leading edge being the first part of the board engaging surface to contact the board, the radial distance from the axis of the shaft to the board engaging surface continuously increasing in a direction from the leading edge to the trailing edge, the area of the board engaging surface increasing from substantially a knife edge to substantially that of the slotting area of the slotting blade.

4. A slotting assembly comprising:

counter-rotating male and female slotting tools arranged to receive a corrugated board therebetween;

a precrush tool having a narrow leading end and a trailing end wider than said leading end and mounted on said male slotting tool for progressively plastically deforming said board to form a crease;

a slotting blade on said male slotting tool following said precrush tool for producing at least one slot in at least one slotting location in said board; and a resilient anvil carried on said female slotting tool which cooperates with said precrush tool when said precrush tool plastically deforms said board.

5. A slotting assembly according to claim 4 wherein said male and said female slotting tools are mounted on spaced parallel shafts.

6. A slotting assembly according to claim 5 wherein said precrush tool increases in circumferential area and diameter in a direction toward said slotting blade.

7. A slotting assembly according to claim 4 wherein said diameter of said precrush tool increases until said diameter equals the pitch circle of said shaft.

8. A slotting assembly according to claim 7 wherein the width of said precrush tool increases until it substantially equals the width of said slotting blade.

9. A slotting assembly according to claim 8 wherein the diameter of said precrush tool at said leading end equals said pitch circle minus the maximum caliper of the corrugated board.

* * * * *